US007165954B2

(12) United States Patent
Kim

(10) Patent No.: US 7,165,954 B2
(45) Date of Patent: Jan. 23, 2007

(54) APPARATUS FOR PREVENTING VACUUM STATE IN SCROLL COMPRESSOR

(75) Inventor: Su-Chul Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 23 days.

(21) Appl. No.: 11/020,098

(22) Filed: Dec. 27, 2004

(65) Prior Publication Data

US 2006/0140803 A1 Jun. 29, 2006

(51) Int. Cl.
*F04C 18/00* (2006.01)
*F01C 1/02* (2006.01)

(52) U.S. Cl. ..... 418/55.1; 417/310

(58) Field of Classification Search ..... 418/55.1–55.5, 418/57, 270; 137/538; 417/308, 310; *F04C 18/02, F04C 18/00*
See application file for complete search history.

(56) References Cited

U.S. PATENT DOCUMENTS

2003/0206812 A1* 11/2003 Cho ..... 417/310
2003/0206813 A1* 11/2003 Koo ..... 417/310

FOREIGN PATENT DOCUMENTS

EP 1229246 A2 * 8/2002
KR 2002022454 A * 3/2002
KR 2002027994 A * 4/2002
KR 1020040017966 A 3/2004
KR 2004098457 A * 11/2004

* cited by examiner

*Primary Examiner*—Theresa Trieu
(74) *Attorney, Agent, or Firm*—Birch, Stewart, Kolasch & Birch, LLP

(57) ABSTRACT

An apparatus for preventing a vacuum state in a scroll compressor including a hermetic container divided into a high pressure space and a low pressure space; a fixed scroll provided inside the hermetic container; and an orbiting scroll orbiting in a state of being interlocked with the fixed scroll, comprises: a connecting passage for connecting the high pressure space, the low pressure space and a compression pocket to each other, wherein the compression pocket is formed by a wrap of the fixed scroll and a wrap of the orbiting scroll; a slider movably inserted in the connecting passage, for allowing the high pressure space and the low pressure space of the hermetic container to communicate with or be blocked from each other by a pressure difference between the low pressure space of the hermetic container and the compression pocket; and an elastic support means for elastically supporting the slider, thereby preventing vacuumization of the inside of the hermetic container in operation, and making a smooth operation for preventing the vacuumization.

9 Claims, 5 Drawing Sheets

APPARATUS FOR PREVENTING VACUUM STATE IN SCROLL COMPRESSOR

BACKGROUND OF THE INVENTION

1. Field of the Invention

The present invention relates to a scroll compressor, and particularly, to an apparatus for preventing a vacuum state in a scroll compressor which can prevent the inside of a hermetic container from being vacuumized and facilitate an operation for preventing the vacuumization.

2. Description of the Background Art

In general, a compressor converts electric energy to kinetic energy and compresses a refrigerant gas by the kinetic energy. The compressor is a core factor which constitutes a refrigerating cycle system, and is classified into a variety of kinds such as a rotary compressor, a scroll compressor, a reciprocal compressor and the like. Such compressors are commonly used for a refrigerator, an air conditioner, a show case and the like.

FIG. 1 shows one example of the scroll compressor. As shown, the scroll compressor includes: a hermetic container 10; a main frame 20 and a sub frame 30 fixedly coupled to upper and lower portions of the hermetic container 10, respectively; a driving motor 40 positioned between the main frame 10 and the sub frame 20 and fixedly coupled to the inside of the hermetic container 10; a fixed scroll 50 fixedly coupled inside the hermetic container 10 at a certain interval between itself and the main frame 20; an orbiting scroll 60 placed between the fixed scroll 50 and the main frame 20 and orbiting in a state of being interlocked with the fixed scroll 50; a rotary shaft 70 transferring a driving force of the driving motor 40 to the orbiting scroll 60; an Oldham ring 80 inserted between the orbiting scroll 60 and the main frame 20, for preventing self-rotation of the orbiting scroll 60; and a high and low pressure separation plate 90 for separating an internal space of the hermetic container 10 into a high pressure space (H) and a low pressure space (L).

A suction pipe 1 for suction of a gas and a discharge pipe 2 for discharge of a gas are coupled to the hermetic container 10. The suction pipe 1 is placed at the low pressure space (L), and the discharge pipe 2 is placed at the high pressure space (H). The low pressure space (L) of the hermetic container 10 is a space where a gas is sucked, and the high pressure space (H) is a space where the compressed is discharged. Oil to be supplied to a sliding portion is filled in a lower portion of the hermetic container 10.

The fixed scroll 50 is provided with a body portion 51 having a predetermined shape; a wrap 52 formed at a lower portion of the body 51 as an involute shape; and a discharge hole 53 penetratingly formed at the center of the of the body 51.

The orbiting scroll 60 includes: a circular plate portion 61 having a predetermined area; a wrap 62 formed at an upper surface of the circular plate portion 61 as an involute shape; and a boss portion 63 formed at a lower surface of the circular plate 61.

The driving motor 40 comprises: a stator 42 fixedly coupled to an inner circumferential surface of the hermetic container 10; a winding coil 43 wound around the stator 42; and a rotor 44 rotatably inserted in the stator 42.

The rotary shaft 70 is provided with an eccentric portion 71. The rotary shaft 70 is pressingly inserted in the rotor 44 and is penetratingly inserted in the main frame 50, so that its eccentric portion 71 is inserted in the boss portion 63 of the orbiting scroll.

Undescribed reference mark 100 is a backflow preventing means for preventing backflow of a discharge gas.

The operation of the scroll compressor having such a structure will now be described.

First, the driving motor 40 is operated upon receiving power. When the rotary shaft 70 rotates upon receiving a rotary force of the driving motor 40, the orbiting scroll 60 coupled to the eccentric portion 71 of the rotary shaft orbits centering on the center of the rotary shaft 70. The orbiting scroll 60 does not rotate due to the Oldham ring 80 but orbits.

As the orbiting scroll 60 orbits, the wrap 62 of the orbiting scroll orbits in a state of being interlocked with the wrap 52 of the fixed scroll. Thus, a plurality of compression pockets (P) are formed by the wraps 62 and 52 of the orbiting scroll and the fixed scroll, and move to center portions of the fixed scroll 50 and the orbiting scroll 60, and the volumes of the compression pockets (P) are changed, thereby sucking and compressing a gas and discharging the compressed gas through the discharge hole 53 of the fixed scroll.

The compression pockets (P) are continuously formed as the orbiting scroll 60 orbits. When positioned at an edge of the fixed scroll 50, the compression pockets (P) are in a low pressure state, which is suction pressure, and when positioned at the center of the fixed scroll 50, the compression pockets (P) are in a high pressure state, which is discharge pressure. Also, when positioned between the edge and the center of the fixed scroll 50, they are in a middle pressure state.

High temperature high pressure gas discharged through the discharge hole 53 of the fixed scroll flows outside the hermetic container 10 through the high pressure space (H) of the hermetic container 10 and the discharge pipe 2.

The scroll compressor constitutes a refrigerating cycle system. In the refrigerating cycle system, the high temperature high pressure gas discharged from the scroll compressor by the operation of the scroll compressor passes through a condenser, a capillary tube and an evaporator. The gar having passed through the evaporator is introduced into the scroll compressor, and such circulation processes are repeated.

Meanwhile, if the operation of the scroll compressor is continued in a state that a gas is blocked and thus is not sucked into the hermetic container 10 of the scroll compressor through the suction pipe 1 because of problems occurring in the refrigerating cycle system or in a suction side of the scroll compressor, the low pressure space (L) of the hermetic container 10 is maintained in a vacuum state. If the low pressure space (L) of the hermetic container 10 is vacuumized, vacuum discharge is generated at a terminal portion placed at the low pressure space (L) side of the hermetic container 10 and connected to the driving motor 40, thereby causing the compressor to be damaged. Particularly, if the terminal and an insulation coating connected to the terminal become defective, the probabilities of vacuum discharge are raised.

Also, because the driving motor 40 is positioned in the low pressure space (L) of the hermetic container 10, if the low pressure space (L) of the hermetic container is maintained in the vacuum state, heat generated at the driving motor 40 is not effectively transmitted to the outside. For this reason, the driving motor 40 is over-heated, thereby causing the insulation film of a wire to be damaged.

Many researches are actively ongoing in order to solve such problems. As one of methods for solving the problems, a connecting passage allowing the high pressure space (H) and the low pressure space (L) of the hermetic container 10 to communicate with each other is provided, and a valve which reacts to a gas temperature of the high pressure space (H) of the hermetic container 10 is provided at the connecting passage side. When the high pressure space (H) of the hermetic container 10 is at a set temperature or higher, the valve reacts to the temperature and opens the connecting passage. In such a manner, the high pressure space (H) and the low pressure space (L) of the hermetic container 10 communicate with each other, thereby preventing vacuumization of the low pressure space (L) of the hermetic container 10.

However, such a method is disadvantageous in that if more than a certain pressure does not work on the connecting passage, operation of the valve is degraded or is not made at all.

SUMMARY OF THE INVENTION

Therefore, an object of the present invention is to provide an apparatus for preventing a vacuum state in a scroll compressor capable of preventing vacuumization of the inside of a hermetic container by allowing a high pressure space and a low pressure space of the hermetic container to selectively communicate with or be blocked from each other using a pressure difference between the low pressure space of the hermetic container and a compression pocket formed by a wrap of an orbiting scroll and a wrap of a fixed scroll, and of allowing smooth operation for communication or isolation of the high pressure space and the low pressure space.

To achieve these and other advantages and in accordance with the purpose of the present invention, as embodied and broadly described herein, there is provided an apparatus for preventing a vacuum state in a scroll compressor including a hermetic container divided into a high pressure space and a low pressure space; a fixed scroll provided inside the hermetic container; and an orbiting scroll orbiting in a state of being interlocked with the fixed scroll, comprising: a connecting passage for connecting the high pressure space, the low pressure space and a compression pocket to each other, wherein the compression pocket is formed by a wrap of the fixed scroll and a wrap of the orbiting scroll; a slider movably inserted in the connecting passage, for allowing the high pressure space and the low pressure space of the hermetic container to communicate with or be blocked from each other by a pressure difference between the low pressure space of the hermetic container and the compression pocket; and an elastic support means for elastically supporting the slider.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
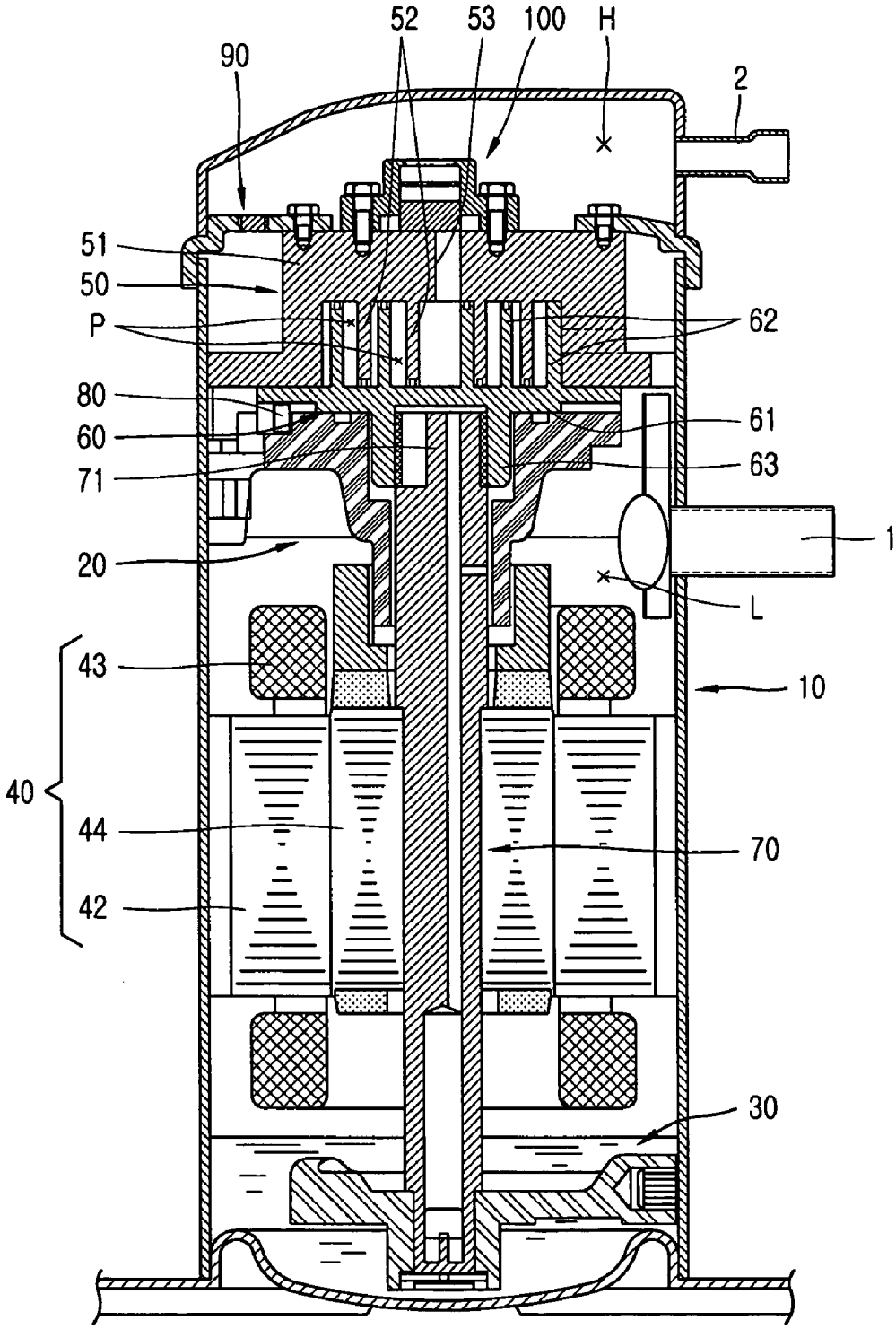
FIG. 1 CONVENTIONAL ART
FIG. 1 is a sectional view showing a general scroll compressor.
Figure 2:
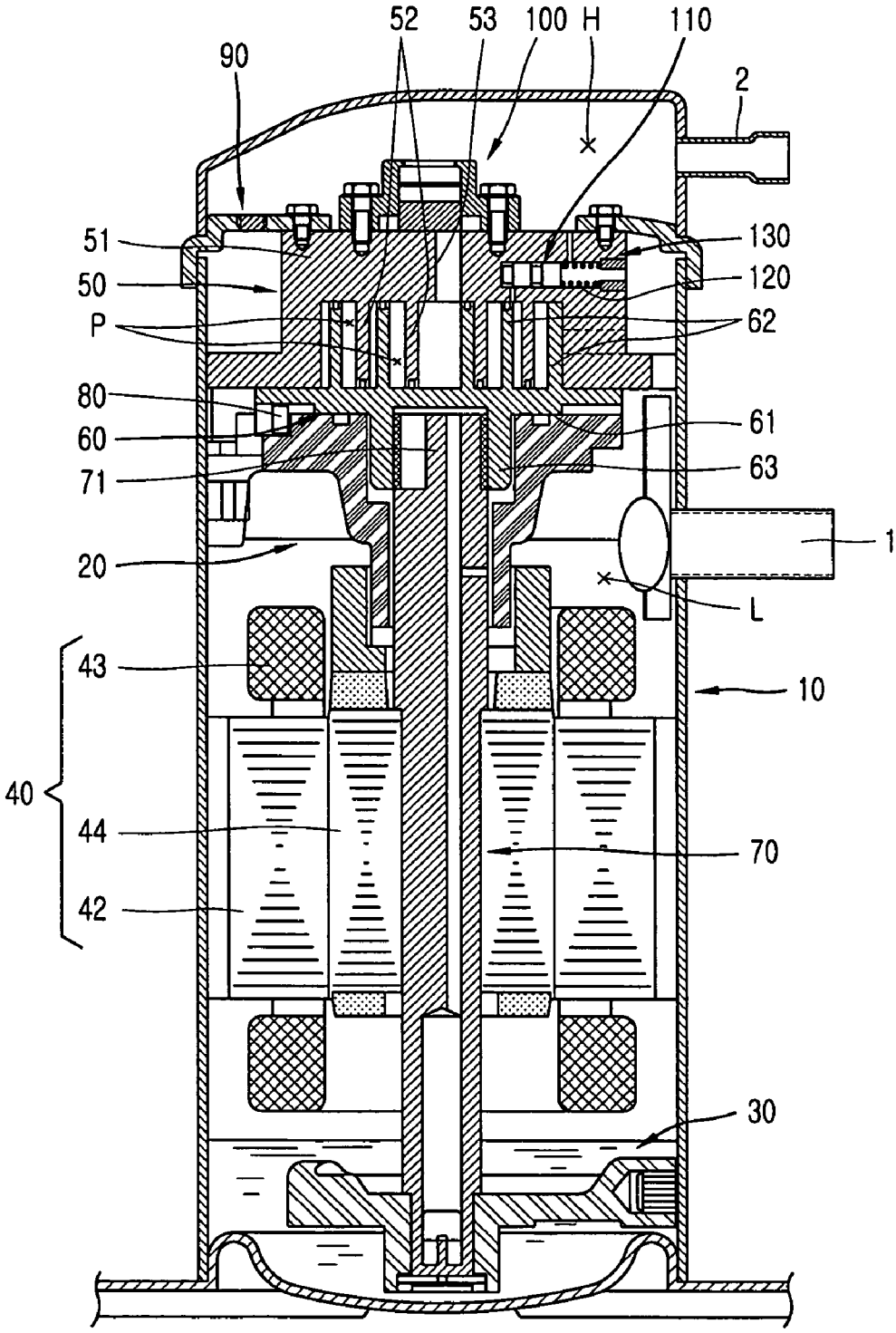
FIG. 2 is a sectional view of a scroll compressor provided with an apparatus for preventing a vacuum state in a scroll compressor in accordance with one embodiment of the present invention.
Figure 3:
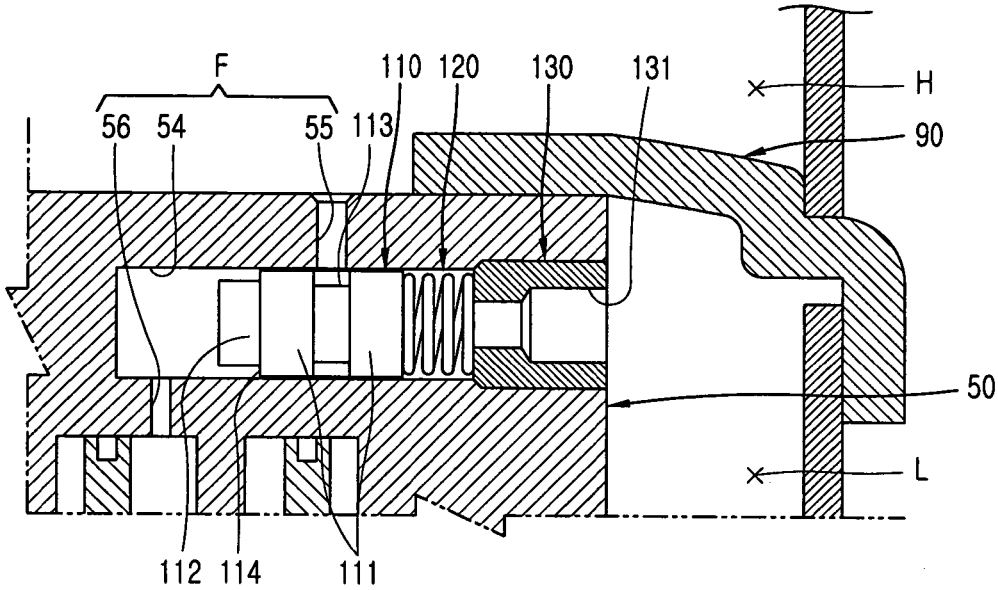
FIG. 3 is a sectional view showing the apparatus for preventing a vacuum state in the scroll compressor in accordance with the present invention.

FIG. 2 is a sectional view of a scroll compressor provided with an apparatus for preventing a vacuum state in a scroll compressor in accordance with one embodiment of the present invention, and FIG. 3 is a sectional view showing the apparatus for preventing a vacuum state in the scroll compressor in accordance with the present invention. Like reference numerals designate like or corresponding parts to those of the conventional art.

As shown, the scroll compressor provided with the apparatus for preventing a vacuum state of the scroll compressor in accordance with the present invention includes: a hermetic container 10; a main frame 20 and a sub frame 30 fixedly coupled to upper and lower portions inside the hermetic container 10, respectively; a driving motor 40 positioned between the main frame 10 and the sub frame 20 and fixedly coupled inside the hermetic container 10; a fixed scroll 50 fixedly coupled inside the hermetic container 10 at a certain interval from the main frame 20; an orbiting scroll 60 positioned between the fixed scroll 50 and the main frame 20 and orbiting in a state of being interlocked with the fixed scroll 50; a rotary shaft 70 for transferring a driving force of the driving motor 40 to the orbiting scroll 60; an Oldham ring 80 inserted between the orbiting scroll 60 and the main frame 20, for preventing self-rotation of the orbiting scroll 60; and a high and low pressure separation plate 90 for separating the inside of the hermetic container 10 into a high pressure space (H) and a low pressure space (L). One side of the high and low pressure separation plate 90 is coupled to an upper surface of the fixed scroll 50, and the other side of the high and low pressure separation plate 90 is coupled to the hermetic container 10.

A suction pipe 10 through which a gas is sucked and a discharge pipe 2 through which a gas is discharged are coupled to the hermetic container 10. The suction pipe 1 is positioned at the low pressure space (L), and the discharge pipe 2 is positioned at the high pressure space (H). Oil to be supplied to a sliding portion is filled in a lower portion of the hermetic container 10.

Such a structure is the same as that of the conventional art, and the detailed descriptions thereon will be omitted.

The apparatus for preventing a vacuum state in accordance with one embodiment of the present invention includes: a connecting passage (F) for connecting the high pressure space (H), the low pressure space (L), and compression pockets (P), which are formed by the wrap 52 of the fixed scroll and the wrap 62 of the orbiting scroll, to one another; a slider 110 movably inserted in the connecting passage (F), for allowing the low pressure space (L) and the high pressure space (H) of the hermetic container 10 to communicate with and be blocked from each other by a pressure difference between the low pressure space (L) of the hermetic container 10 and the compression pocket (P); and an elastic support means for elastically supporting the slider 110.

The connecting passage (F) is preferably provided at the fixed scroll 50.

The fixed scroll 50 is provided with a body 51 having a predetermined shape; a wrap 52 formed at a lower portion of the body 51 as an involute shape; and a discharge hole 53 penetratingly formed at the center of the body 51.

The connecting passage (F) includes: a sliding hole 54 formed at a side surface of the body 51 of the fixed scroll at a certain depth; a first hole 55 formed at the body 51, for allowing an upper surface of the body 51 and the sliding hole 54 to communicate with each other; and a second hole 56 formed at the body 51, for allowing the sliding hole 54 and the compression pocket (P) to communicate with each other.

The sliding hole 54 is formed parallel to the upper surface of the body 51 and preferably has a circular section. The sliding hole 54 is exposed to the low pressure space (L) of the hermetic container 10. Preferably, the second hole 56 is positioned more adjacent to the central portion of the fixed scroll 50 than the first hole 55. The first hole 55 and the second hole 56 are formed vertically, and an inner diameter of the first hole 55 is smaller than that of the sliding hole 54.

Of the compression pockets (P) formed by the wrap 52 of the fixed scroll and the wrap 62 of the orbiting scroll, a compression pocket (P) where the second hole 56 is positioned is a pocket to which middle pressure is applied.

The slider 110 includes: a body 111 having a certain length and a sectional shape corresponding to a sectional shape of the sliding hole 54; a stepped protrusion 112 extending from one side of the body 111, having a certain length and a cross sectional area smaller than that of the body 111, to which pressure of the compression pocket (P) is applied; and a ring shaped groove 113 formed at an outer circumferential surface of the body 111 as a ring shape having certain width and depth. A stepped surface 114 is formed at a portion where the stepped protrusion 112 and the body 111 are connected together, by a sectional difference between the stepped protrusion 112 and the section of the body 111.

The slider 110 is inserted in the connecting passage (F) with its stepped protrusion 112 positioned toward a central portion of the fixed scroll 50. As for the length of the stepped protrusion 112 of the slider 110, when an end surface of the stepped protrusion 112 comes in contact with an end surface of the sliding hole 54, the other end of the stepped protrusion 112 is positioned within the second hole 56.

Figure 4:
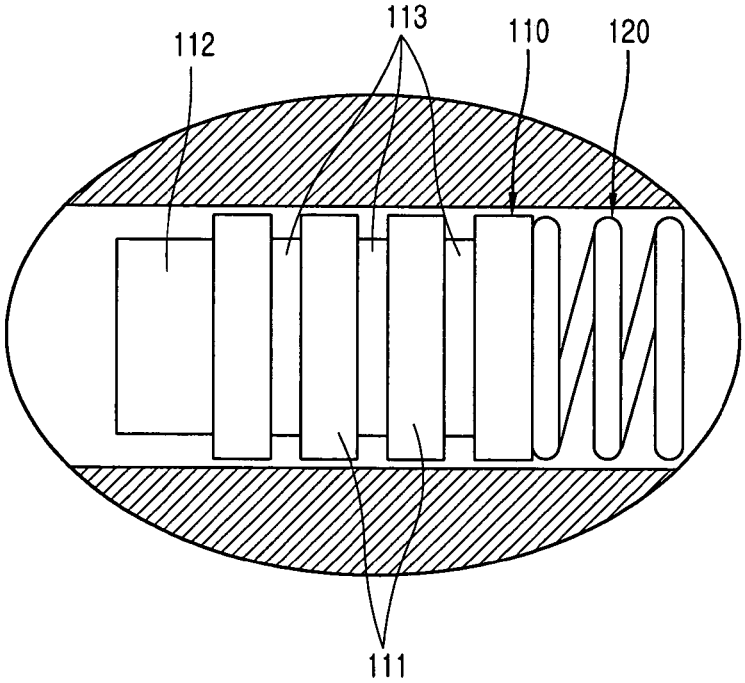
FIG. 4 is a sectional view showing a modified example of a slider constituting the apparatus for preventing a vacuum state in the scroll compressor in accordance with the present invention.

In a modified example of the slider 110, as shown in FIG. 4, a plurality of ring-shaped grooves 113 are formed at the body 111 of the slider. As the plurality of ring-shaped grooves 113 are formed at an outer circumferential surface of the body 111, the body 111 is divided into a plurality.

The elastic support means includes: a spring 120 inserted in the connecting passage (F), for elastically supporting the slider 110; and a spring support tube 130 having therein a through hole 131 and pressingly inserted in the sliding hole 54, for supporting the spring 120.

Preferably, the spring 120 is a compression coil spring. One side of the spring 120 is supported on one side surface of the spring support tube 130, and its other side is supported on one side surface of the slider 110. The through hole 131 of the spring support tube communicates with the sliding hole 54.

Hereinafter, the operation and the effect of the apparatus for preventing a vacuum state in the scroll compressor in accordance with the present invention will now be described.

First, as described in the conventional art, the scroll compressor is operated in such a manner that the rotary shaft 70 rotates upon receiving a rotary force of the driving motor 40 and the orbiting scroll 60 coupled to the eccentric portion 71 of the rotary shaft orbits centering on the center of the rotary shaft 70.

As the orbiting scroll 60 orbits, the wrap 62 of the orbiting scroll orbits in a state of being interlocked with the wrap 52 of the fixed scroll. Then, a plurality of compression pockets (P) are formed by the wrap 62 of the orbiting scroll and the wrap 52 of the fixed scroll and move toward the central portions of the fixed scroll 50 and the orbiting scroll 60, and volumes of the pockets (P) are changed, thereby sucking and compressing a gas and discharging the compressed gas through the discharge hole 53 of the fixed scroll.

The high temperature high pressure gas discharged through the discharge hole 53 of the fixed scroll flows outside the hermetic container 10 through the high pressure space (H) of the hermetic container 10 and the discharge pipe 2.

Figure 5:
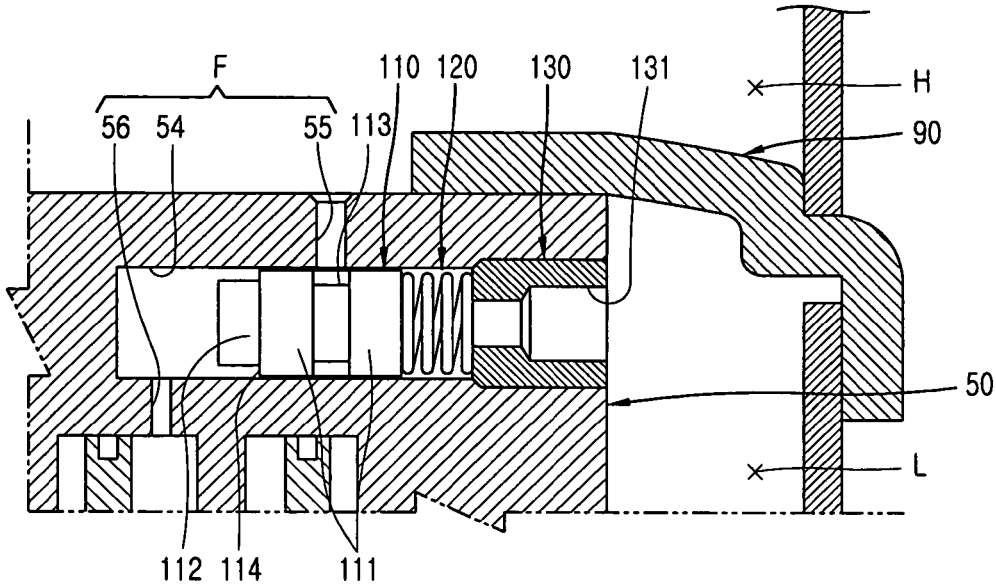
FIGS. 5 and 6 are sectional views showing the operation of the apparatus for preventing a vacuum state in the scroll compressor in accordance with the present invention.

As shown in FIG. 5, in a normal operation state, pressure of the low pressure space (L) works on one side of the slider 110 inserted in the sliding hole 54, and pressure of the compression pocket (P), which is middle pressure, works on the other side of the slider 110. The middle pressure of the compression pocket (P) works on the slider 110 through the second hole 56. By a pressure difference between both sides of the slider 110, the slider 110 compresses the spring 120, moving and being placed toward the spring 120. As the slider 110 moves and is positioned toward the spring 120, the slider 110 blocks the first hole 55, so that the first hole 55 to which the discharge pressure, which is high pressure, is applied cannot communicate with the low pressure space (L) of the hermetic container 10. Preferably, it is designed that the ring-shaped groove 113 of the slider is positioned at the first hole 55 in a state that the slider 110 has moved toward the spring 120.

Meanwhile, if a gas is not introduced through the suction pipe 1 or the introduction is not actively made during operation of the scroll compressor because of blockage of the suction pipe 1 through which a gas is sucked, the gas existing in the hermetic container 10 is compressed by the fixed scroll 50 and the orbiting scroll 60 and is discharged to the high pressure space (H) of the hermetic container 10, thereby gradually vacuumizing the low pressure space (L) of the hermetic space 10.

Figure 6:
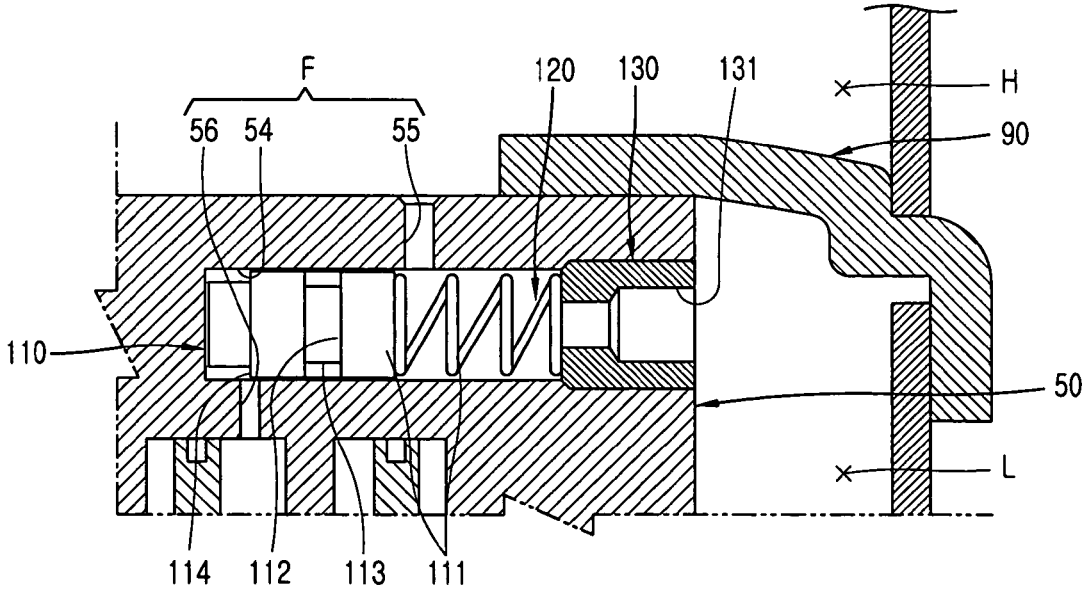

As shown in FIG. 6, if the low pressure space (L) of the hermetic container 10 is gradually vacuumized, the amount of gas introduced into the compression pocket (P) formed by the wrap 62 of the orbiting scroll and the wrap 52 of the fixed scroll is reduced, thereby lowering the pressure of the compression pocket (P). Thus, the pressure difference between the low pressure space (L) of the hermetic container 10 and the compression pocket (P) becomes small, and the slider 110 moves inside the sliding hole 54 by an elastic force of the spring 120.

As the slider 110 moves inside the sliding hole 54, the first hole 55 communicates with the low pressure space (L) of the hermetic container 10 through part of sliding hole 54, so that the gas of the high pressure space (H) of the hermetic container 10 flows to the low pressure space (L) of the hermetic container 10 through the first hole 55 and the sliding hole 54.

The gas flowing to the low pressure space (L) of the hermetic container 10 is discharged to the high pressure space (H) of the hermetic container 10 through the compression pocket (P) formed by the wrap 62 of the orbiting scroll and the wrap of the fixed scroll. By repeating such processes, even though suction of a gas through the suction pipe 1 is blocked, the vacuumization of the low pressure space (L) of the hermetic container 10 is prevented.

Figure 7:
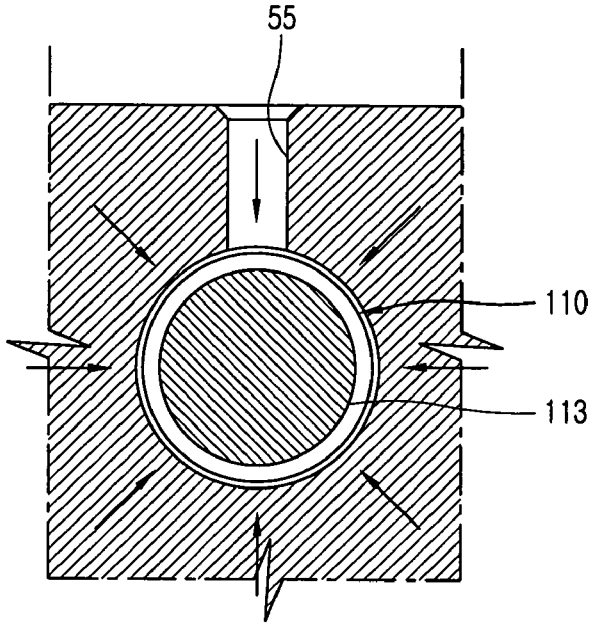
FIGS. 7 and 8 are sectional views showing the operation of a ring-shaped groove constituting the apparatus for preventing a vacuum state of the scroll compressor in accordance with the present invention.

Meanwhile, as shown in FIG. 7, if the ring-shaped groove 113 of the slider 110 coincides with the first hole 55 in a state that the slider 110 has moved toward the spring 120, pressure of the high pressure space (H) of the hermetic container 10 is applied to the entire ring-shaped groove 113 through the first hole 55, so that the high pressure working through the first hole 55 is distributed to the entire ring-shaped groove 113. Therefore, by the pressure difference between both sides of the slider 110 and the elastic force of the spring 120, the movement of the slider 110 becomes smooth. If there is no ring-shaped groove 113 on the outer circumferential surface of the slider 110, the pressure of the high pressure space (H) of the hermetic container 10 works on only one portion of the outer circumferential surface of the slider 110 through the first hole 55, whereby the movement of the slider 110 cannot be smooth.

Figure 8:
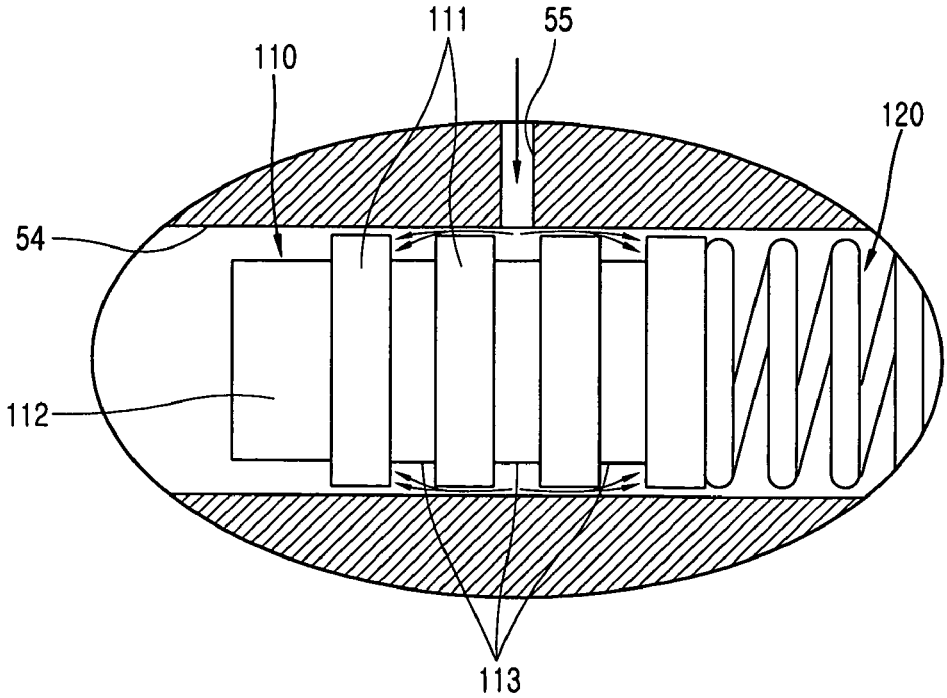

In addition, the ring-shaped groove 113 is formed on the outer circumferential surface of the slider 110, it can be minimized that the high pressure working through the first hole 55 is leaked between an inner circumferential surface of the sliding hole 54 and an outer circumferential surface of the slider 110 in a state that the slider 110 blocks the first hole 55. As shown in FIG. 8, if a plurality of ring-shaped grooves 113 are formed on the outer circumferential surface of the slider 110, the gas leaked between the outer circumferential surface of the slider 110 and the inner circumferential surface of the sliding hole 54 is repetitively re-expanded in the ring-shaped grooves 113, thereby more effectively preventing the leakage of the gas.

As so far described, the apparatus for preventing a vacuum state in the scroll compressor in accordance with the present invention prevents a vacuum state in the hermetic container when a gas is not smoothly sucked into the hermetic container through the suction pipe or when the suction of the gas is blocked during operation of the compressor, so that damage of the compressor, which may be generated due to the vacuum state in the hermetic container, is prevented. Accordingly, reliability of the compressor is improved.

Also, the ring-shaped groove formed on the outer circumferential surface of the slider allows a smooth movement of the slider, thereby quickly and sensitively preventing vacuumization of the hermetic container and thus improving reliability. Also, the ring-shaped groove prevents leakage of gas, thereby improving compression efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing a vacuum state in a scroll compressor including a hermetic container divided into a high pressure space and a low pressure space; a fixed scroll provided inside the hermetic container; and an orbiting scroll orbiting in a state of being interlocked with the fixed scroll, comprising:

a connecting passage for connecting the high pressure space, the low pressure space and a compression pocket to each other, wherein the compression pocket is formed by a wrap of the fixed scroll and a wrap of the orbiting scroll;

a slider movably inserted in the connecting passage, for allowing the high pressure space and the low pressure space of the hermetic container to communicate with or be blocked from each other by a pressure difference between the low pressure space of the hermetic container and the compression pocket, the slider including:

a body having a certain length and a sectional shape corresponding to that of the sliding hole;

a stepped protrusion extending from one side of the body and having a certain length and a sectional area smaller than that of the body, to which pressure of the compression pocket side is applied; and a plurality of ring-shaped grooves formed on an outer circumferential surface of the body, each of the plurality of ring-shaped grooves including a flat bottom portion; and an elastic support means for elastically supporting the slider.

2. The apparatus of claim 1 wherein the connection passage is provided at the fixed scroll.

3. The apparatus of claim 2, wherein the connecting passage comprises:

a sliding hole formed at a side portion of the fixed scroll and exposed to the low pressure space of the hermetic container;

a first hole formed at the fixed scroll, for communication between the high pressure space of the hermetic container and the sliding hole; and a second hole formed at the fixed scroll, for communication between the sliding hole and the compression pocket.

4. The apparatus of claim 3, wherein the compression pocket where the second hole is positioned is a pocket to which the middle pressure is applied, wherein the compression pocket to which the middle pressure is applied is one of compression pockets formed by the wrap of the fixed scroll and the wrap of the orbiting scroll.

5. The apparatus of claim 3, wherein the second hole is positioned more adjacent to a central portion of the fixed scroll than the first hole.

6. The apparatus of claim 3, wherein the first hole is positioned at an upper surface of the fixed scroll.

7. The apparatus of claim 1 wherein the slider is inserted in the connecting passage with its stepped protrusion positioned toward the central portion of the fixed scroll.

8. The apparatus of claim 1 wherein the elastic support means comprises: a spring inserted in the connecting passage, for elastically supporting the slider; and a spring support tube having a through hole therein and pressingly inserted in the connecting passage, for supporting the spring.

9. The apparatus of claim 1 wherein each of the plurality of ring-shaped grooves include a pair of side walls that extend perpendicular to the flat bottom portion.

* * * * *